US006419331B2

(12) United States Patent
Wei

(10) Patent No.: US 6,419,331 B2
(45) Date of Patent: Jul. 16, 2002

(54) FRAME STRUCTURE OF PLAYING MACHINE

(75) Inventor: Ming Shan Wei, Kaohsiung (TW)

(73) Assignee: Paokai Electronic Enterprise Co., Ltd., Kaohsiung (TW)

( * ) Notice: Subject to any disclaimer, the term of this patent is extended or adjusted under 35 U.S.C. 154(b) by 0 days.

(21) Appl. No.: 09/749,886

(22) Filed: Dec. 29, 2000

(30) Foreign Application Priority Data

Aug. 3, 2000 (TW) ..... 89213489 U

(51) Int. Cl.[7] ..... A47B 47/00

(52) U.S. Cl. ..... 312/265.1; 312/265.4; 312/140

(58) Field of Search ..... 312/114, 138.1, 312/140, 257.1, 265.1, 265.4, 265.5, 265.6; 211/182, 189

(56) References Cited

U.S. PATENT DOCUMENTS 2,174,180 A * 9/1939 Rand ..... 312/140
2,956,705 A * 10/1960 Clingman ..... 312/140 X
4,997,240 A * 3/1991 Schmalzl et al. ..... 312/265.4
5,003,741 A * 4/1991 Yeh ..... 312/140 X
5,470,139 A * 11/1995 Hsiao ..... 312/140
5,549,372 A * 8/1996 Lewis ..... 312/140 X
5,695,263 A * 12/1997 Simon et al. ..... 312/265.1 X
5,839,248 A * 11/1998 Liang ..... 312/140 X
6,082,837 A * 7/2000 Battochio et al. ..... 312/140

* cited by examiner

*Primary Examiner*—James O. Hansen
(74) *Attorney, Agent, or Firm*—Bacon & Thomas, PLLC

(57) ABSTRACT

A frame structure of a playing machine includes upright posts located at corner positions of the entire frame and each having an outer face provided with two outer grooves facing outward. A transverse rod has two ends each defining a positioning hole for securing the transverse rod to the upright post by a positioning member. The transverse rod itself defines an insertion groove. The insertion grooves of two adjacent transverse rods align with each other for allowing insertion of a glass piece or a plate. Alternatively, a frame rod has a protruding plate inserted into the outer groove or the insertion groove, and has an insertion groove allowing insertion of a glass piece or a plate. The transverse rod is provided with a locking groove for allowing insertion of a press plate which co-operates with the lip of the transverse rod to clip a partition plate.

17 Claims, 7 Drawing Sheets

FRAME STRUCTURE OF PLAYING MACHINE

BACKGROUND OF THE INVENTION

1. Field of the Invention

The present invention relates to a frame structure of a playing machine, and more particularly to a frame structure of a playing machine having a simple construction which can be assembled easily.

2. Description of the Related Prior Art

A conventional frame structure of a doll catching machine according to the prior art as shown in FIG. 9 comprises a bottom frame 91 having three directional angled connectors 94 and four directional angled connectors 96, an intermediate frame 92 mounted on the bottom frame 91 and having three directional angled connectors 94 and three directional positioning connectors 95, and a top frame 93 mounted on the intermediate frame 92 and having three directional angled connectors 94 and three directional positioning connectors 95.

However, in assembly, the bottom frame 91, the intermediate frame 92, and the top frame 93 are initially assembled with each other, and are then combined with each other by the three directional angled connectors 94, the three directional positioning connectors 95, and the four directional angled connectors 96, thereby causing inconvenience during the assembling process. In addition, at least two workers are needed to lift the intermediate frame 92 and the top frame 93, while another worker is needed to assemble the bottom frame 91, the intermediate frame 92, and the top frame 93, thereby wasting more manual work. Further, the frame structure of the doll catching machine after being assembled lacks an enough strength.

SUMMARY OF THE INVENTION

The primary objective of the present invention is to provide a frame structure of a playing machine, wherein only a single worker can accomplish assembling the construction of the frame structure, thereby facilitating the worker assembling the frame structure of the playing machine.

Another objective of the present invention is to provide a frame structure of a playing machine, wherein the frame structure of the playing machine after being assembled has a better strength.

In accordance with the present invention, there is provided a frame structure of a playing machine including a plurality of upright posts located at comer positions of the entire frame. Each of the upright posts has an outer face provided with two outer grooves facing outward. The outer grooves of two adjacent upright posts align with each other for allowing insertion of a glass piece or a plate. A plurality of transverse rods each have two ends each defining a positioning hole for securing the transverse rod to the upright post by a positioning member. Each of the transverse rods itself defines at least one insertion groove or two insertion grooves. The insertion grooves of two adjacent transverse rods align with each other for allowing insertion of a glass piece or a plate. Alternatively, a frame rod has a protruding plate inserted into the outer groove of the upright post or the insertion groove of the transverse rod, and has an insertion groove allowing insertion of a glass piece or a plate. The transverse rod is provided with a locking groove for allowing insertion of a press plate which co-operates with the lip of the transverse rod to clip a partition plate.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
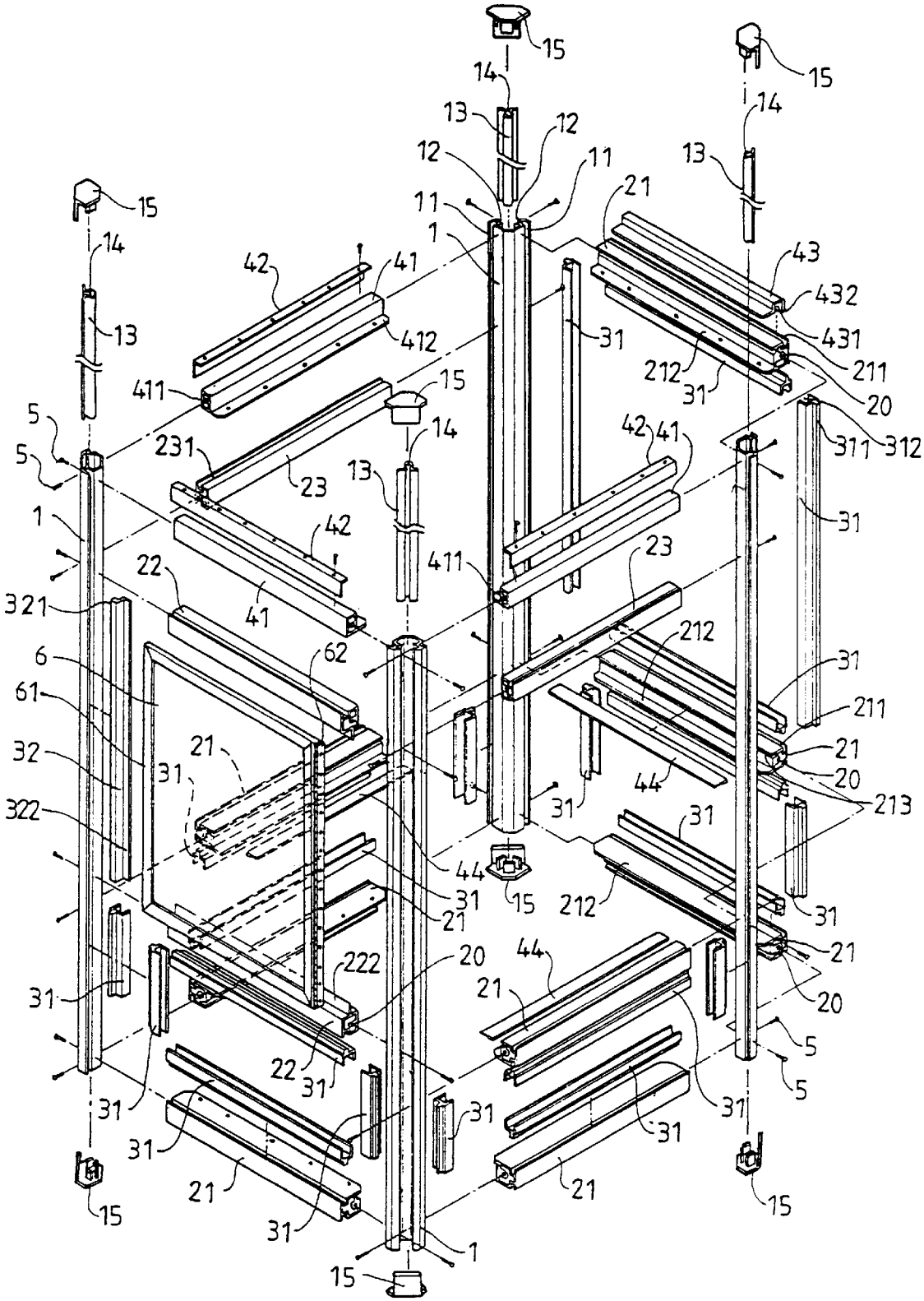
FIG. 1 is an exploded perspective view of a frame structure of a playing machine in accordance with the present-invention.

Referring to the drawings and initially to FIG. 1, a frame structure of a playing machine in accordance with the present invention comprises a plurality of upright posts 1, a plurality of transverse rods 2, a plurality of frame rods 3, and a plurality of press plates 4.

Figure 2:
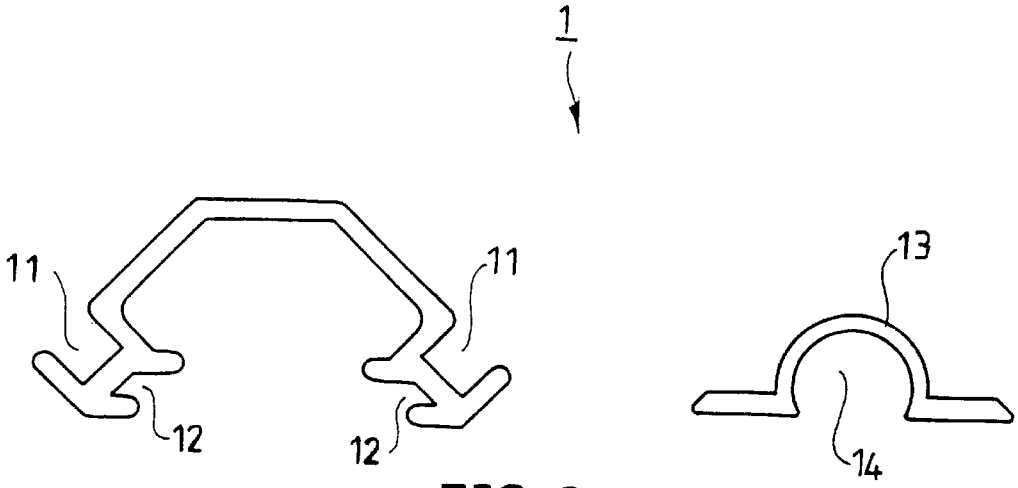
FIG. 2 is a plan view of an upright post of the frame structure of a playing machine as shown in FIG. 1.

Referring to FIGS. 1 and 2, the upright posts 1 are the main posts constructing the entire frame, and as shown in the figures, are located at the four corner positions of a rectangular box. Each of the upright posts 1 has a substantially C-shaped cross-section. Each of the upright posts 1 has an outer face provided with two outer grooves 11 facing outward. In the preferred embodiment, preferably, the included angle between the two outer grooves 11 is equal 90°. The outer grooves 11 of two adjacent upright posts 1 align with each other for allowing insertion of a wall plate. In addition, the upright rod 1 defines two opposite inner grooves 12, for allowing insertion of an ornamental plate 13. The ornamental plate 13 is made of a transparent material, and as shown in the figure, has a through channel 14 for fitting a neon lamp. Further, a cover 15 is used for covering the top and bottom end faces of the upright post 1, thereby enhancing the aesthetic quality of the upright post 1.

Figure 3:
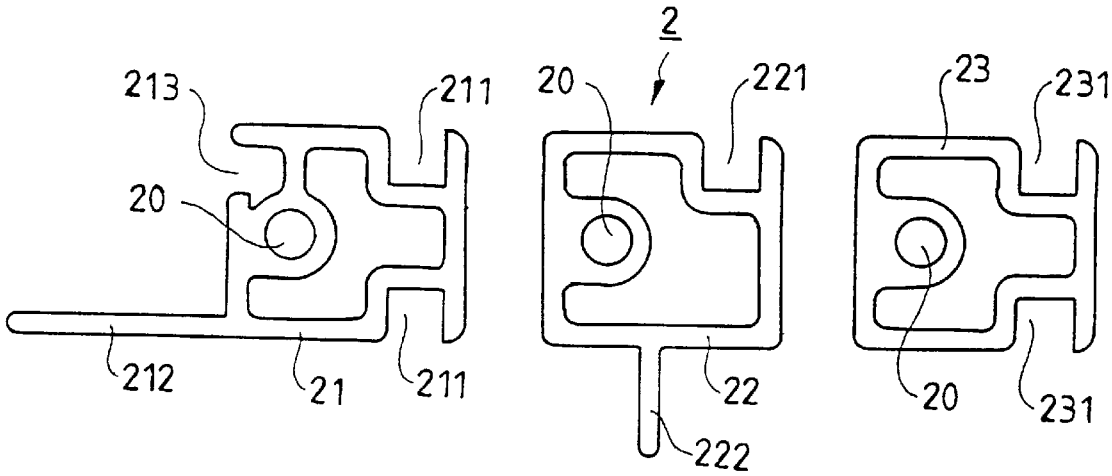
FIG. 3 is a plan view of a transverse rod of the frame structure of a playing machine as shown in FIG. 1.
Figure 7:
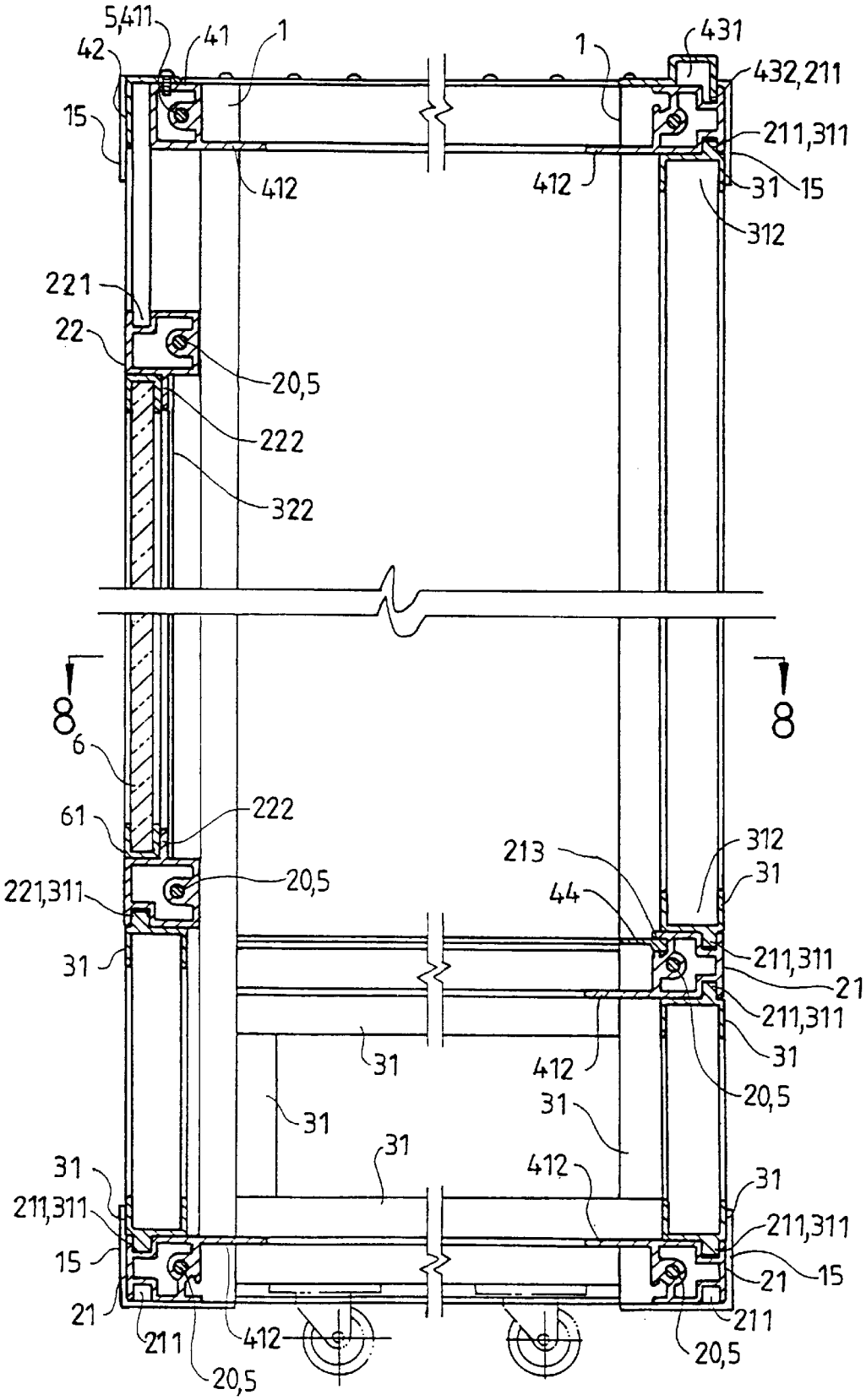
FIG. 7 is a front plan cross-sectional assembly view of the frame structure of a playing machine along the line 7—7 as shown in FIG. 6.

Referring to FIGS. 1 and 3, the transverse rods 2 are mounted between the upright posts 1, for securing the upright posts 1, thereby achieving a better strength. For satisfying different requirements, the transverse rod 2 includes a first transverse rod 21, a second transverse rod 22, and a third transverse rod 23. Each of the transverse rods has two ends each defining a positioning hole 20 for securing each of the transverse rods to the upright post 1 by means of a positioning member 5. In the preferred embodiment, when the transverse rod 2 is made of an extrusion material, the positioning hole 20 is a through hole penetrating through the inner wall of the transverse rod 2. Each of the transverse rods 2 itself defines at least one insertion groove or two insertion grooves, and the insertion grooves of two adjacent transverse rods 2 align with each other for allowing insertion of a glass piece or a plate, thereby forming the wall of the whole frame. In the preferred embodiment as shown in the figures, the first transverse rod 21 has two opposite faces each defining an insertion groove 211, the second transverse rod 22 has two opposite faces respectively provided with an insertion groove 221 and an upright plate 222, and the third transverse rod 23 has two opposite faces each defining an insertion groove 231. The first transverse rod 21 is mounted on the bottom, side face and back face of the entire frame, and has a lip 212 and a locking groove 213. The lip 212 is used for supporting a plate, and is secured by a positioning member (not shown), thereby forming the partition, back face and bottom of the entire frame, and the plate of the closed bottom is further used for securing wheels as shown in FIG. 7. The locking groove 213 receives therein a fourth press plate 44 which co-operates with the lip 212 to clip a glass piece or a plate. The second transverse rod 22 is mounted on the front side of the entire frame, while the upright plate 222 is rested on a door plate 6 for stopping movement of the door plate 6 when the door plate 6 is closed. The third transverse rod 23 is mounted on the two sides of the entire frame.

Figure 4:
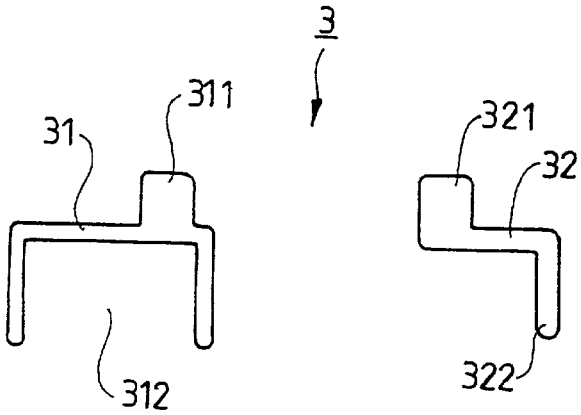
FIG. 4 is a plan view of a frame rod of the frame structure of a playing machine as shown in FIG. 1.

Referring to FIGS. 1 and 4, the frame rod 3 is inserted in the upright post 1, and includes a first frame rod 31, and a second frame rod 32. The first frame rod 31 is provided with a protruding plate 311 inserted into the outer groove 11 of the upright post 1, and an insertion groove 3 12 allowing insertion of a glass piece or a plate. The second frame rod 32 is provided with a protruding plate 321 inserted into the outer groove 11 of the upright post 1, and an upright plate 322 rested on the door plate 6 for stopping movement of the door plate 6 when the door plate 6 is closed.

Figure 5:
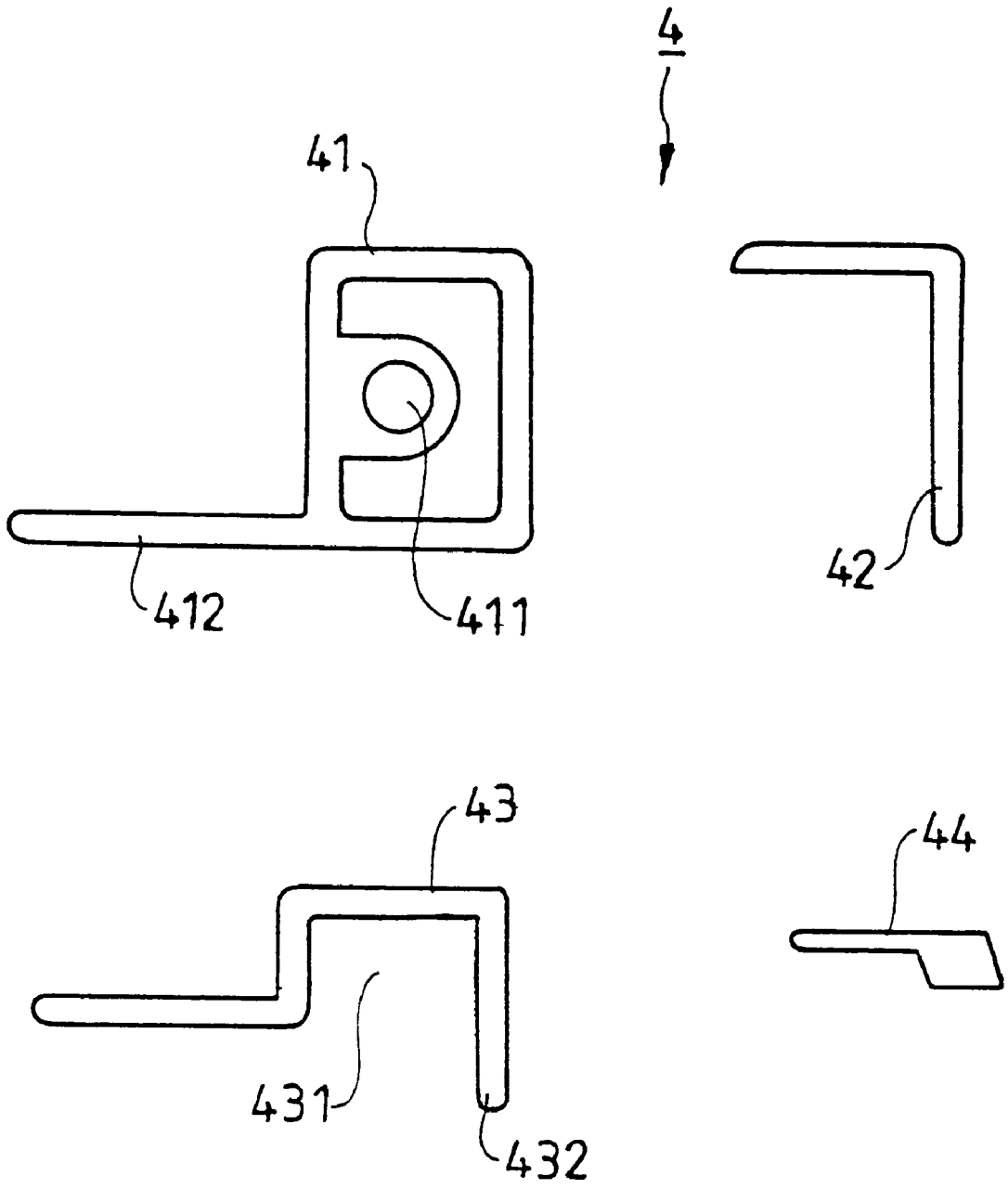
FIG. 5 is a plan view of a press plate of the frame structure of a playing machine as shown in FIG. 1.

Referring to FIGS. 1 and 5, the press plate 4 is used for fixing a glass piece or a plate, and includes a first press plate 41, a second press plate 42, a third press plate 43, and a fourth press plate 44. The first press plate 41 has two ends each defining a positioning hole 411 for securing the first press plate 41 to the upright post 1 by a positioning member 5, and the first press plate 41 is provided with a lip 412 for resting and locking a glass piece or a plate. The second press plate 42 has two vertical wall faces, wherein one of the wall faces is used for securing the first press plate 41 by the positioning member 5, and the other wall face co-operates with the first press plate 41 to clip a plate. The third press plate 43 has an upright plate 432 inserted into the insertion groove 211 of the transverse rod 21 that forms the back portion and the top portion of the entire frame, and the third press plate 43 itself has a groove 431 for collecting electrical wires or cooling pipes. The fourth press plate 44 is inserted into the locking groove 213 of the first transverse rod 21 that separating the entire frame into multiple grid layers, whereby the fourth press plate 44 co-operates with the lip 212 of the first transverse rod 21 to clip the partition plate.

Referring to FIGS. 1 and 7, the door plate 6 may be made of a glass material, and as shown in the figures, is secured on a frame 61 whose one side is mounted to one of the upright posts 1 by a connecting member 62 such as a hinge. Therefore, the door plate 6 may be pivoted to be opened, and the rest sides of the frame 61 is pressed on the upright plate 222 of the second transverse rod 22 and the upright plate 322 of the second frame rod 32. The frame 61 may be provided with a lock, if necessary, to be snapped on the second frame rod 32.

Figure 6:
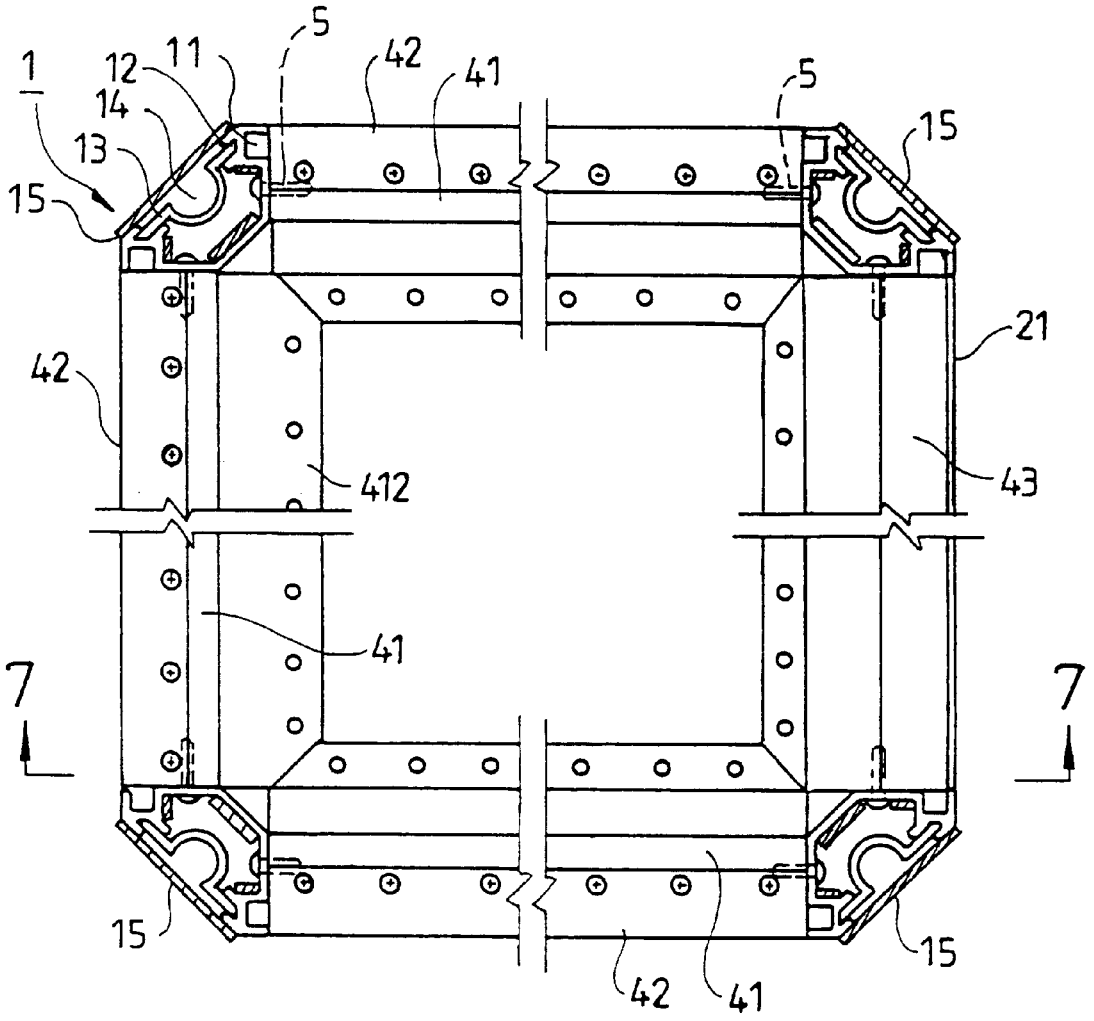
FIG. 6 is a top plan assembly view of the frame structure of a playing machine as shown in FIG. 1.
Figure 8:
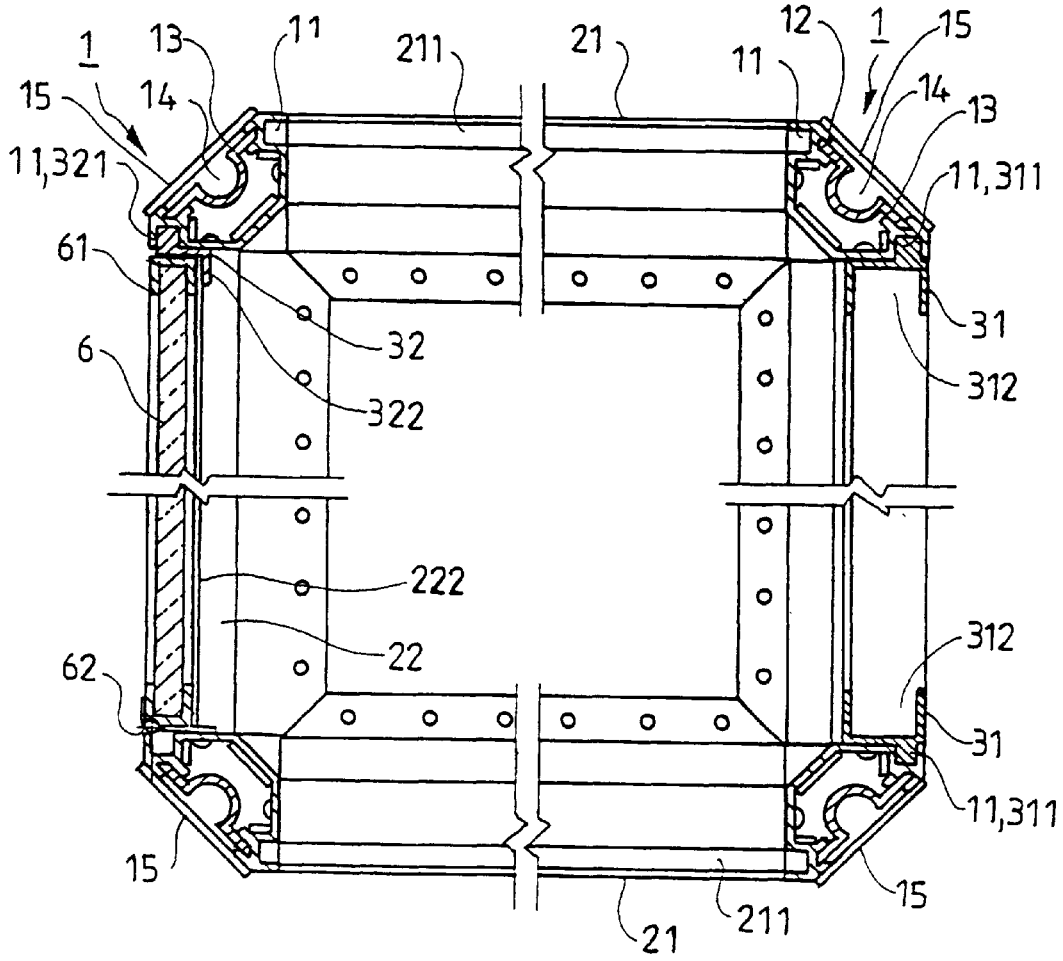
FIG. 8 is a top plan cross-sectional assembly view of the frame structure of a playing machine along the line 8—8 as shown in FIG. 7.
Figure 9:
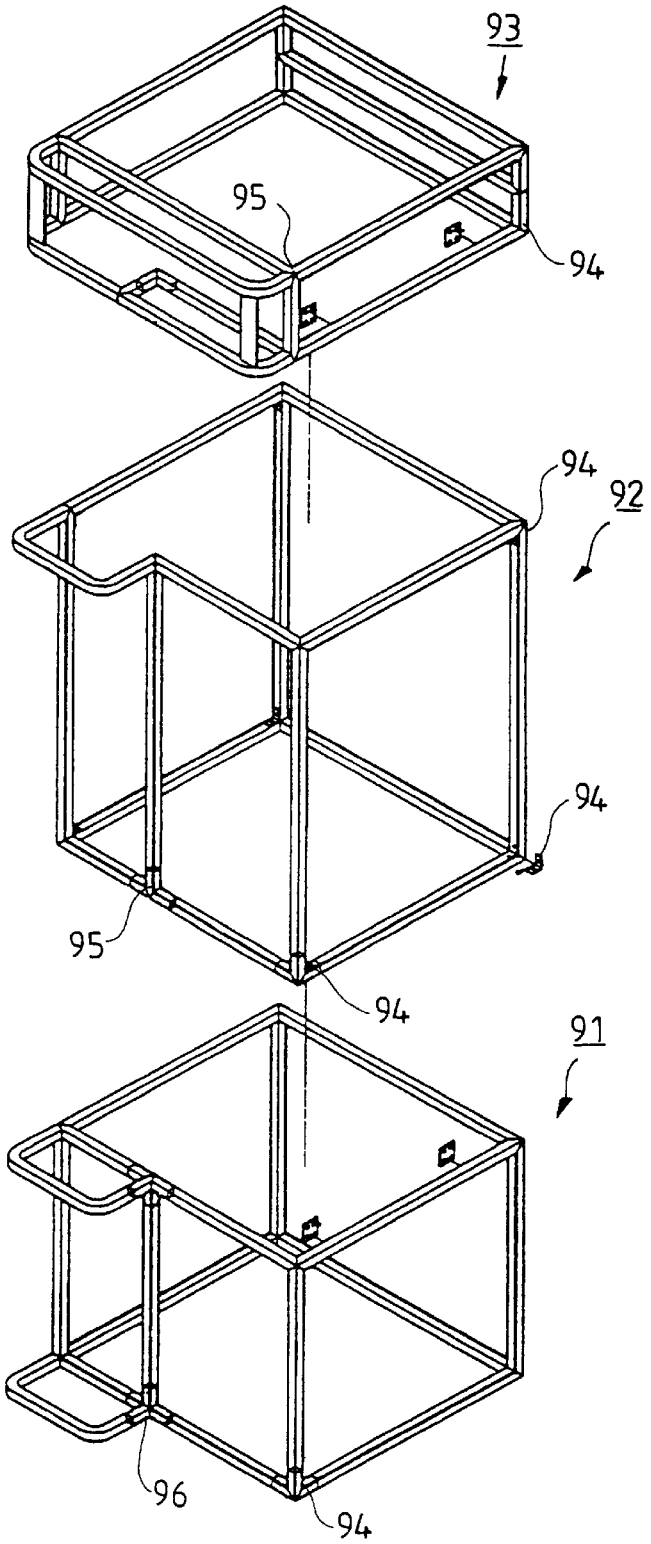
FIG.9 PRIOR ART
FIG. 9 is an exploded perspective view of a conventional frame structure of a playing machine in accordance with the prior art.

Referring to FIGS. 6–8, according to the present invention, the upright posts 1 construct the four comer positions of the entire frame, and a plurality of transverse rods 2 are secured between the four upright posts 1 by means of the positioning members 5 extending through the positioning holes 20. The oppositely aligning insertion grooves 211, 221, and 231 of the transverse rod 2 are used for insertion of glass pieces or plates, or the insertion grooves 211, 221, and 231 of the transverse rod 2 are used for insertion of the protruding plate 311 of the frame rod 3, and then the insertion groove 312 of the frame rod 3 is used for insertion of glass pieces or plates. The first press plate 41, the third press plate 43, and the fourth press plate 44 are respectively inserted or fixed to the first transverse rod 21, to co-operate with the first transverse rod 21 to clip or fix the plates of the top, bottom or partition. The door plate 6 is secured on one of the upright posts 1, thereby forming the frame of the playing machine.

Accordingly, only a single worker is needed to hold a positioning member fixing tool to accomplishing assembling the construction of the frame structure of the playing machine, thereby facilitating the worker assembling the frame structure of the playing machine, and the frame structure after being assembled has a better strength.

Although the invention has been explained in relation to its preferred embodiment as mentioned above, it is to be understood that many other possible modifications and variations can be made without departing from the scope of the present invention. It is, therefore, contemplated that the appended claims will cover such modifications and variations that fall within the true scope of the invention.

What is claimed is:

1. A frame structure of a playing machine comprising:

a plurality of upright posts, located at corner positions of an entire frame, each of the upright posts having an outer face provided with two outer grooves facing outward, the outer grooves of two adjacent upright posts aligning with each other for allowing insertion of a glass piece or a plate;

a plurality of transverse rods, each having two ends each defining a positioning hole for securing one of the transverse rods to one of the upright posts by a positioning member, each of the transverse rods itself defining at least one insertion groove or two insertion grooves, the insertion grooves of two adjacent transverse rods aligning with each other for allowing insertion of a glass piece or a plate;

a first press plate secured between tops of the upright posts;

a second press plate mounted to the first press plate; and a third press plate being adapted to secure a glass piece or a plate, the third press plate having an upright plate inserted into the insertion groove of one of the transverse rods to form a back top portion of the entire frame.

2. The frame structure of a playing machine as claimed in claim 1, wherein each of the upright posts defines two opposite inner grooves, for allowing insertion of an ornamental plate.

3. The frame structure of a playing machine as claimed in claim 2, wherein the ornamental plate is made of a transparent material, and has a through channel.

4. The frame structure of a playing machine as claimed in claim 1, wherein each of the transverse rods has a lip and a locking groove, the locking groove receiving therein a press plate which co-operates with the lip to clip a glass piece or a plate.

5. the frame structure of a playing machine as claimed in claim 1, wherein each of the transverse rods is provided with an upright plate.

6. The frame structure of a playing machine as claimed in claim 1, wherein the outer groove of each of the upright posts or the insertion groove of each of the transverse rods allows insertion of a protruding plate of a frame rod, the frame rod having an insertion groove for allowing insertion of a glass piece or a plate.

7. The frame structure of a playing machine as claimed in claim 1, wherein the outer groove of each of the upright posts or the insertion groove of each of the transverse rods allows insertion of a protruding plate of a frame rod.

8. The frame structure of a playing machine as claimed in claim 1, wherein the first press plate is secured between the tops of the upright posts by a positioning member, the first press plate having a protruding lip for securing a top plate.

9. The frame structure of a playing machine as claimed in claim 1, wherein the second press plate comprises two vertical wall faces, one of the wall faces thereof being fixed, and another one of the wall faces thereof co-operating with the transverse rods or the second or third press plate to clip a plate.

10. The frame structure of a playing machine as claimed in claim 1, further comprising a door plate, the door plate secured on one of the upright posts by a connecting member.

11. The frame structure of a playing machine as claimed in claim 1, further comprising a door plate, the door plate secured on one of the upright posts by a frame.

12. A frame structure of a playing machine comprising:

a plurality of upright posts, located at corner positions of an entire frame, each of the upright posts having an outer face provided with two outer grooves facing outward and two opposite inner grooves, the outer grooves of two adjacent upright posts aligning with each other, the two inner grooves allowing insertion of an ornamental plate;

a plurality of traverse rods, including a first transverse rod, a second transverse rod, and a third transverse rod, the first transverse rod and the third transverse rod having two opposite faces each defining an insertion groove, the second transverse rod having two opposite faces respectively provided with an insertion groove and an upright plate, each of the transverse rods having two ends each defining a positioning hole for securing one of the traverse rods to one of the upright posts by a positioning member, the insertion grooves of two adjacent transverse rods aligning with each other;

a plurality of frame rod, including a first frame rod, and a second frame rod, the first frame rod provided with a protruding plate and an insertion groove, the protruding plate inserted into the outer groove of one of the upright posts or the insertion groove of one of the transverse rods, the insertion groove allowing insertion of a glass piece or a plate;

a press plate, having two ends each defining a positioning hole for securing the press plate to the upright post by a positioning member, and provided with a lip for locking a glass piece or a plate; and a door plate, having one side pivotally connected by a connecting member to one of the upright posts to rotate, and become engaged with the upright plate of the second transverse rod and the upright plate of the second frame rod.

13. The frame structure of a playing machine as claimed in claims 12, wherein the ornamental plate is made of a transparent material, and has a through channel.

14. The frame structure of a playing machine as claimed in claims 12, wherein the transverse rod has a lip and a locking groove, the locking groove receiving therein a press plate which co-operates with the lip to clip a glass piece or a plate.

15. The frame structure of a playing machine as claimed in claim 12, wherein the transverse rod is provided with an upright plate.

16. The frame structure of a playing machine as claimed in claim 12, further comprising a second press plate, the second press plate having two vertical wall faces, one of the wall faces being fixed, and the other wall face co-operating with the transverse rods or the second press plate to clip a plate.

17. The frame structure of a playing machine as claimed in claim 12, further comprising a third press plate, the third plate having an upright plate, the upright plate inserted into the insertion groove of one of the transverse rods to form a back top portion of the entire frame.

* * * * *